US009713354B2

(12) United States Patent
Bolen

(10) Patent No.: US 9,713,354 B2
(45) Date of Patent: Jul. 25, 2017

(54) TWIST-LOCK BUTTON

(71) Applicant: Robert Bolen, Bethesda, MD (US)

(72) Inventor: Robert Bolen, Bethesda, MD (US)

(73) Assignee: Capitol Industrial Design LLC, Kansas City, MO (US)

( * ) Notice: Subject to any disclaimer, the term of this patent is extended or adjusted under 35 U.S.C. 154(b) by 21 days.

(21) Appl. No.: 14/523,844

(22) Filed: Oct. 25, 2014

(65) Prior Publication Data

US 2015/0135489 A1 May 21, 2015

Related U.S. Application Data

(60) Provisional application No. 61/906,364, filed on Nov. 19, 2013.

(51) Int. Cl.

| | |
|---|---|
| ***A44B 17/00*** | (2006.01) |
| ***A41F 1/00*** | (2006.01) |
| ***A44B 1/30*** | (2006.01) |

(52) U.S. Cl.

CPC ..... *A41F 1/00* (2013.01); *A44B 1/30* (2013.01); *A44B 17/0064* (2013.01); *Y10T 24/4578* (2015.01); *Y10T 24/45089* (2015.01); *Y10T 24/45257* (2015.01)

(58) Field of Classification Search

CPC ..... A41F 1/00; A44B 1/30; A44B 17/0064; Y10T 24/45257; Y10T 24/4578; Y10T 24/45089

See application file for complete search history.

(56) References Cited

U.S. PATENT DOCUMENTS

| | | | | | |
|---|---|---|---|---|---|
| RE21,304 | E | * | 12/1939 | Illsche | A44B 1/30 24/105 |
| 3,344,488 | A | * | 10/1967 | Texier | A44B 99/005 24/580.1 |
| 3,577,608 | A | * | 5/1971 | Texler | A44B 99/005 24/594.11 |
| 3,718,950 | A | * | 3/1973 | Engstrom | F16B 5/0642 24/613 |
| 9,210,959 | B1 | * | 12/2015 | Jankowski | A43B 3/16 |
| D751,460 | S | * | 3/2016 | Jankowski | D11/200 |
| 2016/0000189 | A1 | * | 1/2016 | Bolen | A44B 1/08 24/303 |

* cited by examiner

*Primary Examiner* — Robert J Sandy
*Assistant Examiner* — Louis Mercado
(74) *Attorney, Agent, or Firm* — Duane Morris LLP

(57) ABSTRACT

A twist-lock button configured to securely fasten two articles together. Such a twist-lock button may have four pieces: a handle, a locking portion, a negative, and a button adapter. The negative attaches to an article by way of the button adapter. The locking portion attaches to the handle and passes through a button hole in the article to join with the negative by twisting 180 degrees, thereby fastening the two portions of the article together between the handle and the negative. This mechanism is more durable than hook and loop fasteners, more reliable than buttons and snaps, and less prone to jamming than zippers. In addition, the twist-lock button is easier to use for people with muscular or motor disabilities, such as cerebral palsy, ALS, stroke recoverees, and amputees.

17 Claims, 8 Drawing Sheets

TWIST-LOCK BUTTON

FIELD OF THE INVENTION

The present invention generally relates to fastening systems. Specifically, this invention relates to a twist-lock button configured to securely fasten two articles together. In preferred embodiments of the present invention, the twist-lock button comprises four pieces: a handle, a locking portion, a negative, and a button adapter. The negative attaches to an article by way of the button adapter. The locking portion attaches to the handle and passes through a button hole in the article to join with the negative, thereby fastening the two portions of the article together between the handle and the negative.

BACKGROUND OF THE INVENTION

Fasteners are an important part of sporting. Particularly in extreme applications, such as skiing, snowboarding, sailing, skydiving, bungee jumping, mountaineering, etc., having reliable fasteners for clothing and equipment can mean the difference between life and death. However, standard fasteners of the industry all have some kind of weakness that makes them less than ideal. Snaps, although great for party shirts, tend to come undone under heavy loads and high winds. Buttons pop off or break after prolonged use or in extreme conditions. Zippers are notorious for jamming at the most inopportune moments. And hook-and-loop fasteners tend to wear out over time.

In addition, standard fasteners are often difficult for people who have difficulty with fine motor skills. Young children, stroke recoverees, people with cerebral palsy, ALS, Parkinson's disease, and amputees can find it difficult to manipulate buttons, snaps, zippers and Velcro.

Thus there is a need in the industry for a fastener that is durable, secure, and immune to jamming, while still being easy to use for all people of varying abilities. These and other features and advantages of the present invention will be explained and will become obvious to one skilled in the art through the summary of the invention that follows.

SUMMARY OF THE INVENTION

Figure 1:
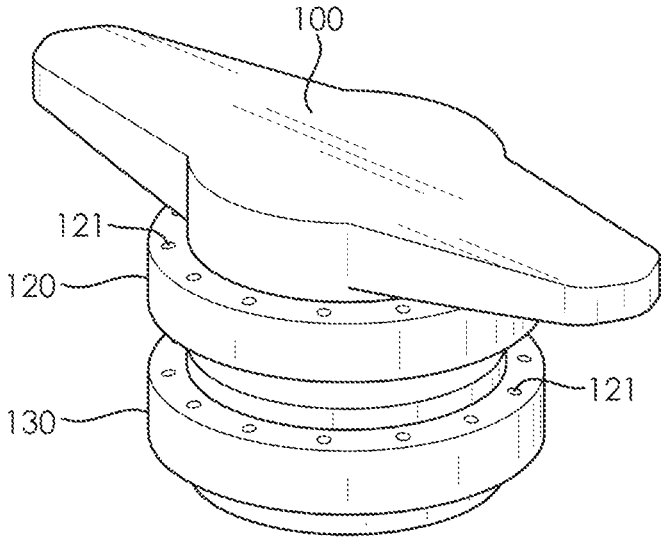
FIG. 1 shows a perspective view of an exemplary embodiment of a twist-lock button, in accordance with an embodiment of the present invention.

Accordingly, it is an object of the present invention to provide a twist lock fastener which is durable, secure, and immune to jamming, while still being easy to use for people of varying abilities.

According to an embodiment of the present invention, a twist-lock fastener comprises a handle comprising a grip portion configured to be rotatable by a human hand; a negative; an attachment means on the negative for attaching the negative to an article of clothing or equipment; a locking portion; and a cylindrical interior cavity with an interior wall and an opening at one end; wherein the handle and the negative mate together by the locking portion being received into the interior cavity and the locking portion and the interior cavity rotate relative to each other into a locked position.

According to an embodiment of the present invention, the locking portion comprises a cylindrical extension.

According to an embodiment of the present invention, the locking portion further comprises a raised ridge extending from the base of the cylindrical extension and moving around the cylindrical extension as the raised ridge approaches the end opposite the base of the cylindrical extension and wherein the interior cavity is configured to engage with the raised ridge and rotate into a locked position.

According to an embodiment of the present invention, the attachment means comprises a plurality of thread holes.

According to an embodiment of the present invention, the attachment means further comprises a perimeter channel recessed into the negative, the perimeter channel formed by an interior sidewall and an exterior sidewall and a plurality of the thread holes passing through the bottom of the perimeter channel.

According to an embodiment of the present invention, the attachments means comprises a surface opposite the opening of the interior cavity for applying an adhesive.

According to an embodiment of the present invention, the attachment means comprises a button adaptor for attaching to an existing button on an article of clothing.

According to an embodiment of the present invention, the locking portion is integrally formed with the negative and the cylindrical interior cavity is formed into a portion of the handle.

According to an embodiment of the present invention, the locking portion is attached to the handle and the cylindrical interior cavity is formed into the negative.

According to an embodiment of the present invention, the locking portion attaches to the handle by a plurality of hooks which snap into matching grooves on a portion of the handle.

According to an embodiment of the present invention, the fastener further comprises a collar formed of a ring of material configured to allow the locking portion to pass through the collar and mate with the interior cavity.

According to an embodiment of the present invention, the collar comprises an attachment means for attaching the collar to an article of clothing or equipment.

According to an embodiment of the present invention, the attachment means comprises a plurality of thread holes.

According to an embodiment of the present invention, the attachment means further comprises a perimeter channel recessed into the collar, the perimeter channel formed by an interior sidewall and an exterior sidewall and a plurality of thread holes passing through the bottom of the perimeter channel.

According to an embodiment of the present invention, the handle rotatably attaches to the collar.

According to an embodiment of the present invention, the handle attaches to the collar by means of a plurality of hooks which pass through the collar and engage with the opposite side of the collar such that the collar and handle rotate freely relative to each other and the handle is retained upon the collar.

According to an embodiment of the present invention, an adapter for attaching a secondary fastener to a button, such as on an article of clothing comprises: a locking plate with a pass-through hole and a pass-through channel extending between the pass-through hole and an outside edge of the locking plate, wherein the locking plate has a plurality of locking channels passing perpendicularly through the locking plate, the locking channels configured to receive locking hooks; and a fastener negative configured to receive a fastener, the fastener negative having a plurality of locking hooks aligned with the locking channels of the locking plate, the locking hooks configured to extend through the locking plate and hold the locking plate flush against the fastener negative when in the locked position.

According to an embodiment of the present invention, the locking hooks pass through the locking channels in the locking plate by entering through a first surface of the locking plate and snapping into the locked position by the hooks being retained on a second surface of the locking plate.

According to an embodiment of the present invention, each of the locking channels are provided with an access passage running from an outside edge of the plate to the locking channel such that the locking hooks rotate into the locked position.

According to an embodiment of the present invention, a retaining nub is positioned between each the access passage and the adjoining the locking channel, wherein the retaining nub protrudes from the edge of the plate and allows the locking hooks to snap into the locked position and the retaining nub prevents the locking hooks from disengaging from the locked position.

DETAILED SPECIFICATION

The present invention generally relates to fastening systems. Specifically, this invention relates to a twist-lock button configured to securely fasten two articles together. In preferred embodiments of the present invention, the twist-lock button comprises four pieces: a handle, a locking portion, a negative, and a button adapter. The negative attaches to an article by way of the button adapter. The locking portion attaches to the handle and passes through a button hole in the article to join with the negative, thereby fastening the two portions of the article together between the handle and the negative.

Figure 2:
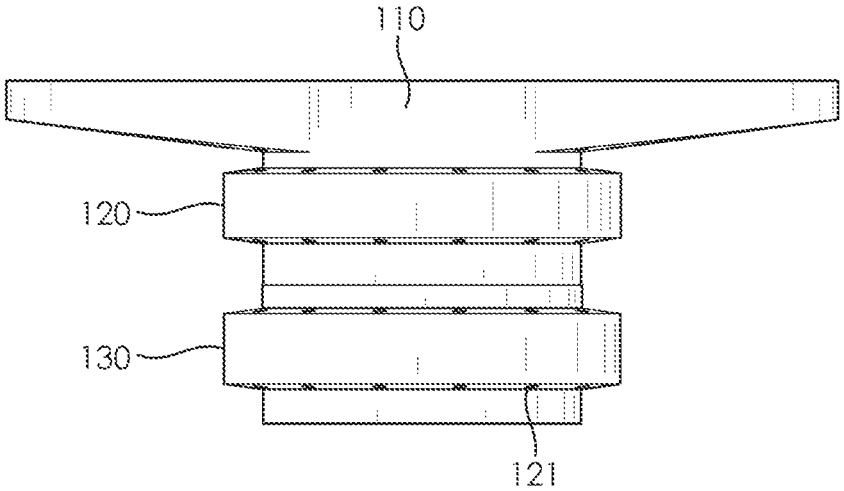
FIG. 2 shows a side view of an exemplary embodiment of a twist-lock button, in accordance with an embodiment of the present invention.

FIGS. 1-2 show views of the twist-lock button with the handle 110 engaged with both the collar 120 and the negative 130 in a locked position. FIG. 1 shows a perspective view of the twist-lock button and FIG. 2 shows a side view of the twist-lock button. According to an embodiment of the present invention shown in FIG. 1 and FIG. 2, the twist-lock button is comprised of three distinct elements: a handle 110, a collar 120, and a negative 130. In one embodiment of the present invention, the handle 110 and collar 120 may be combined into a single component, such that the handle 110 is retained upon the collar 120 in a manner that allows for movement of the handle between a locked and unlocked position without being removed from the collar 120 itself. The handle rotates freely within the collar 120, allowing it to be twisted as much as is required to obtain a secure friction fit.

According to an embodiment of the present invention, both the collar 120 and the negative 130 each have a horizontal ridge around the outer circumference with thread holes 121 perpendicular to the direction of the ridge passing through each ridge from top to bottom. These holes 121 are designed to allow threads to pass through so that the collar 120 and the negative 130 can be sewn or attached to an article, such as a piece of fabric, sporting equipment (e.g., skiing equipment, sailing equipment) or other material that is intended to be removably secured to another article. An example of an article to be secured is a fly of a pair of pants. The negative 130 may be retained on an interior fly wall of the pants. Securing or retention of the negative 130 upon an article can be through any appropriate securing or retention means, such as riveting, sewing, tacking, adhesives, or any combination thereof. One of ordinary skill in the art would appreciate that there are numerous methods for securing a negative 130 on an article, and embodiments of the present invention are contemplated for use with any appropriate methods and/or means.

Figure 3:
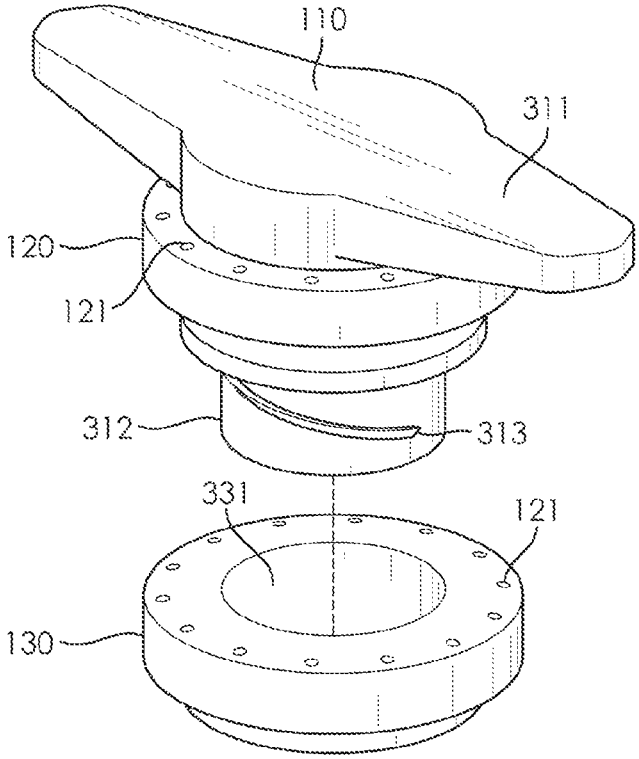
FIG. 3 shows a perspective view of an exemplary embodiment of a twist-lock button, in accordance with an embodiment of the present invention.
Figure 4:
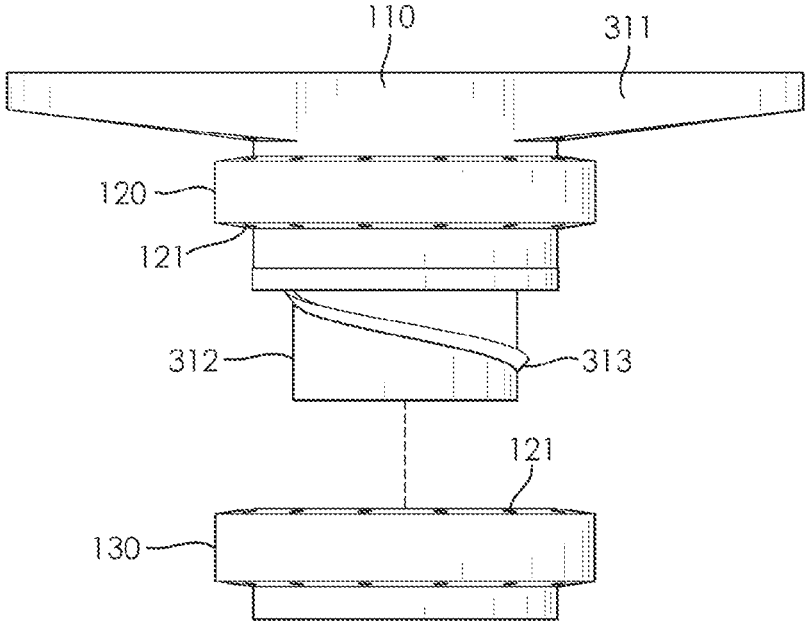
FIG. 4 shows a side view of an exemplary embodiment of a twist-lock button, in accordance with an embodiment of the present invention.

FIGS. 3-4 show the twist-lock button in an unlocked position, with the negative 130 separated from the collar 120 and the handle 110. FIGS. 3-4 also clearly demonstrate the grip portion 311 and locking portion 312 of the handle 110, as well as the interior cavity 331 of the negative 130. Referring now to FIG. 3, according to an embodiment of the present invention, the handle comprises two portions, a grip portion 311 and a locking portion 312. The grip portion 311 is provided such that a user may manipulate the grip portion 311 with ease to twist the handle 110. This allows the grip portion 311 to be utilized to move the locking portion 312 between a locked and an unlocked position. In a preferred embodiment, the grip portion 311 is a T-shape with wings extending from a central body, as shown in FIG. 3 to allow for convenient gripping of the handle 110 by a user. In other embodiments, the grip portion 311 may be rounded or otherwise formed without wings, providing a low-profile format that would prevent the handle 110 from being caught on other materials. One of ordinary skill in the art would appreciate that there are numerous shapes and forms for the handle 110, and embodiments of the present invention are contemplated for use with handles of any form or shape.

According to an embodiment of the present invention, the collar 120 is a circular component with walls forming an opening configured to receive a handle through it, such that the locking portion 312 protrudes from one side of the collar while the handle protrudes from the other side. In one embodiment of the present invention, the collar 120 is configured to retain the handle within the opening such that the handle cannot be removed from the opening of the collar 120. In other embodiments, the handle may be removably attachable to the opening of the collar 120. In yet further embodiments, the opening of the collar 120 may simply allow the securing element of the handle to pass through without having any retention or securing capabilities built thereupon.

According to an embodiment of the present invention, the negative 130 is a circular component with walls forming an interior cavity 331 configured to receive a locking portion 312 of the handle. The locking portion 312 extends from the handle through the collar 120 to fit into and engage with an interior cavity 331 of the negative 130. In a preferred embodiment of the present invention, the locking portion 312 of the handle 110 is a cylindrical element extending from one end of the handle. The locking portion 312 is further formed with an exterior ridge 313 extending perpendicularly from the cylindrical element, beginning at the base of the cylindrical element and wrapping around the perimeter of the cylindrical element while gradually approaching the end of the cylindrical element. The exterior ridge 313 is similar to the thread of a screw or bolt and operates similarly, engaging in a friction fit with a channel formed on the interior cavity 331 of the negative 130. In usage, the locking portion of the handle is inserted into the interior cavity 331 of the negative 130 and twisted in one direction (e.g., clockwise, counterclockwise) to engage the exterior ridge 313 with corresponding parts on the interior cavity 331 of the negative 130, thus locking the pieces together in a friction fit.

It should be understood that moving the twist-lock button from the locked position to an unlocked position simply requires rotation of the handle 110 in the opposite direction that was utilized to enter into the locked position.

In an alternate embodiment of the present invention, the exterior ridge 313 interlocks with a corresponding ridge on the interior cavity 331 of the negative 130. In other words, rather than having a groove or channel that fits snugly around the raised ridge 313 of the locking portion 312, the negative 130 has a corresponding ridge which allows for significant slop between the locking portion 312 and the interior cavity 331 until the handle 110 is twisted, bringing the raised ridge 313 and corresponding ridge into contact with each other to form a secure friction fit. This has the advantage of providing ample room for lining up the locking portion 312 for proper engagement with the negative 130 without having to resort to the fine adjustments that would be required under tighter tolerances. In preferred embodiments, the handle is rotated 180 degrees to enter into a locked position. In other embodiments, any number of rotations may be utilized in order to enter into the locked position. One of ordinary skill in the art would appreciate that any number of rotations could be utilized.

In alternate embodiments, the exterior ridge 313 may be formed on the interior cavity 331 of the negative 130, while the corresponding channel is formed on the locking portion 312 of the handle 110. In still further embodiments, the system may utilize other locking means to allow for the twist-lock connection between the handle 110 and the negative 130. For instance, a pin and groove locking means may be utilized with one or more pins formed on the exterior surface of the locking portion of the handle and a "L", "J" or "U" shaped grooves are formed on an interior wall of the negative 130 such that the one or more pins can be received in the grooves and moved to a locking position by twisting the handle once the pin has reached the bottom of the groove. One of ordinary skill in the art would appreciate that there are numerous types of twist-lock means that could be utilized with embodiments of the present invention, and embodiments of the present invention are contemplated for use with any type of twist-lock means.

Although preferred embodiments of the present invention utilize a negative that is circular in nature, other embodiments may feature a negative that is of any shape. Additionally, other embodiments may include the locking portion incorporated into the negative and the interior cavity for receiving the locking portion incorporated into the handle. One of ordinary skill in the art would appreciate that the same securing features could be utilized with the locking portion and interior cavity attached to either the handle or the negative.

Figure 5:
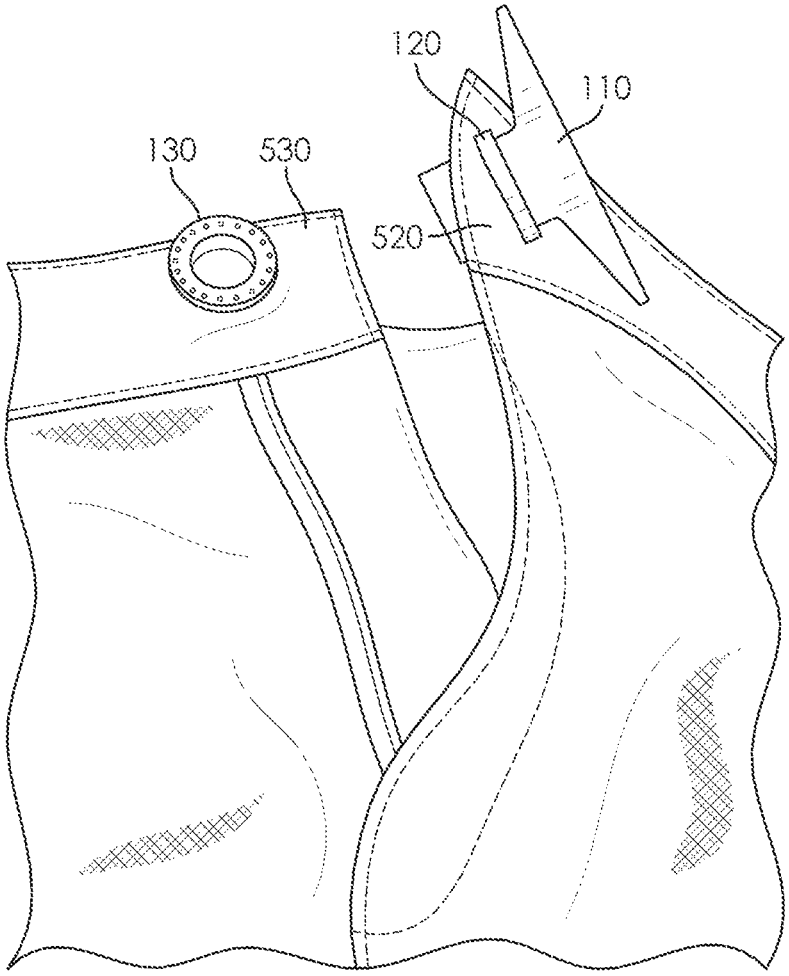
FIG. 5 shows a perspective view of an exemplary embodiment of a twist-lock button in use on a pair of pants, in accordance with an embodiment of the present invention.

FIG. 5 shows an exemplary embodiment of the present invention as it would be utilized. In FIG. 5, the negative 130 is attached to the rear fly 530 of a pair of pants, while the collar 120 is attached to the front fly 520 of the pair of pants. The handle 110 is retained in collar 120. When the locking portion of the handle 110 is engaged with the negative 130, the fly of the pants will be securely fastened.

ALTERNATE EMBODIMENTS

Figure 6:
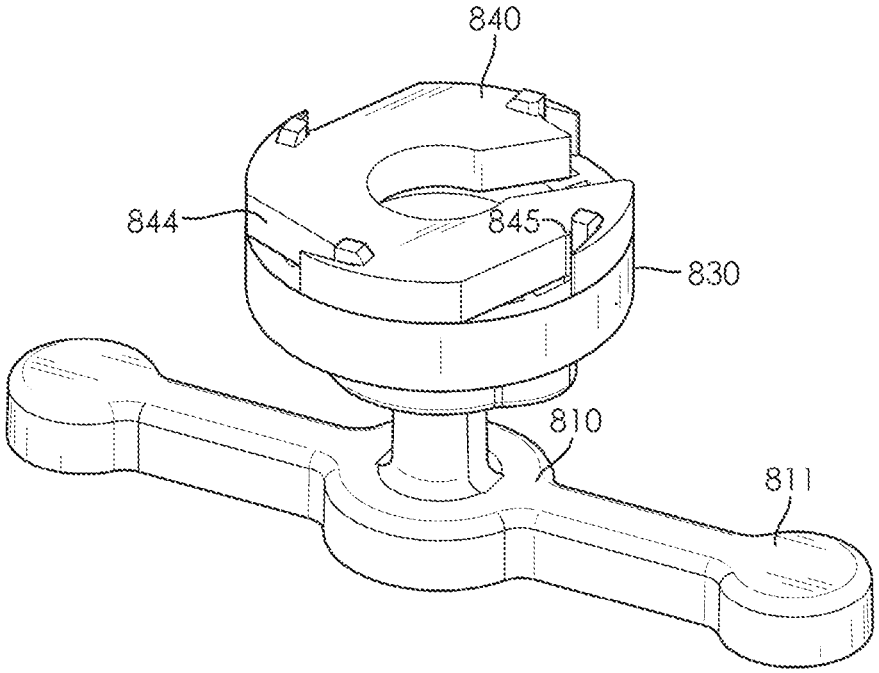
FIG. 6 shows a perspective view of the twist-lock button with a button adapter for attaching to an existing button according to one embodiment of the present invention.
Figure 7:
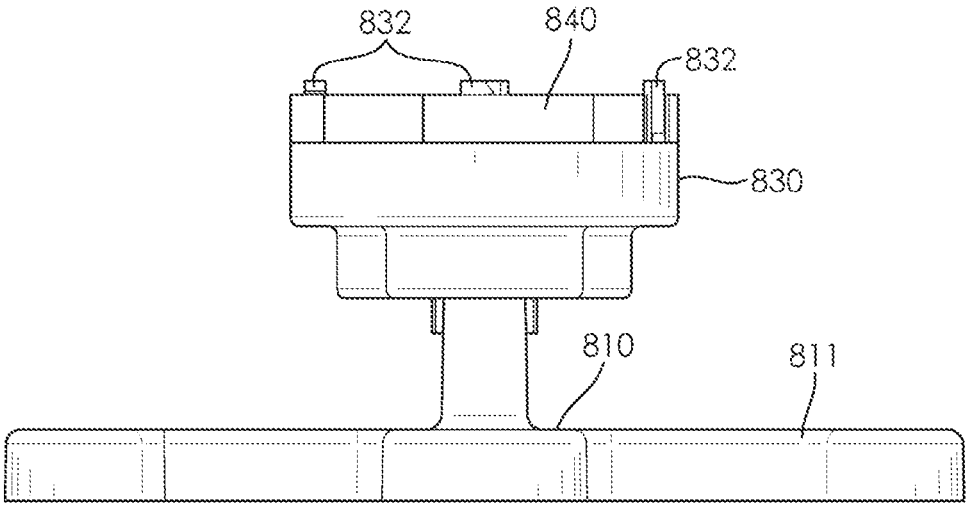
FIG. 7 shows a side profile view of the twist lock button with a button adapter for attaching to an existing button according to one embodiment of the present invention.
Figure 8:
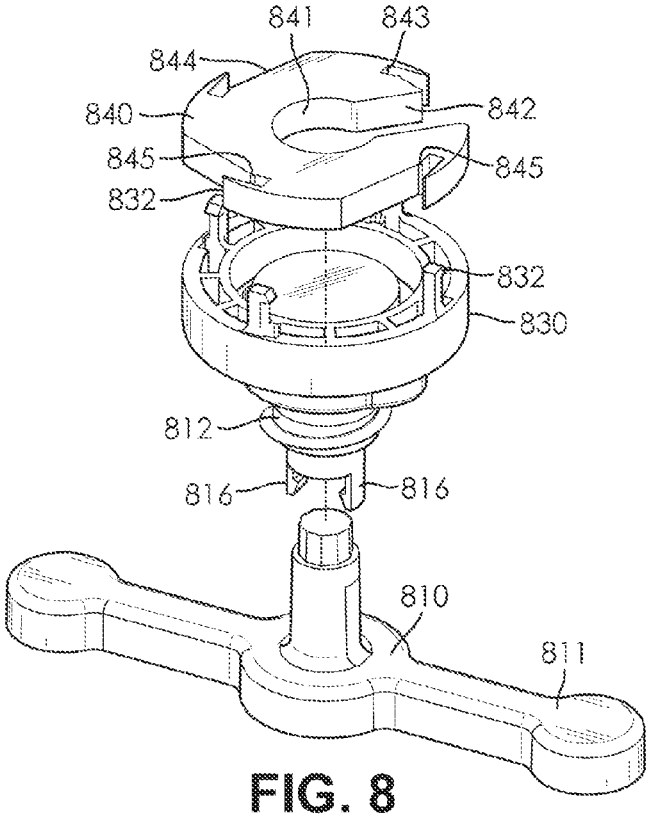
FIG. 8 shows an exploded perspective view of the twist-lock button with a button adapter for attaching to an existing button according to one embodiment of the present invention.
Figure 9:
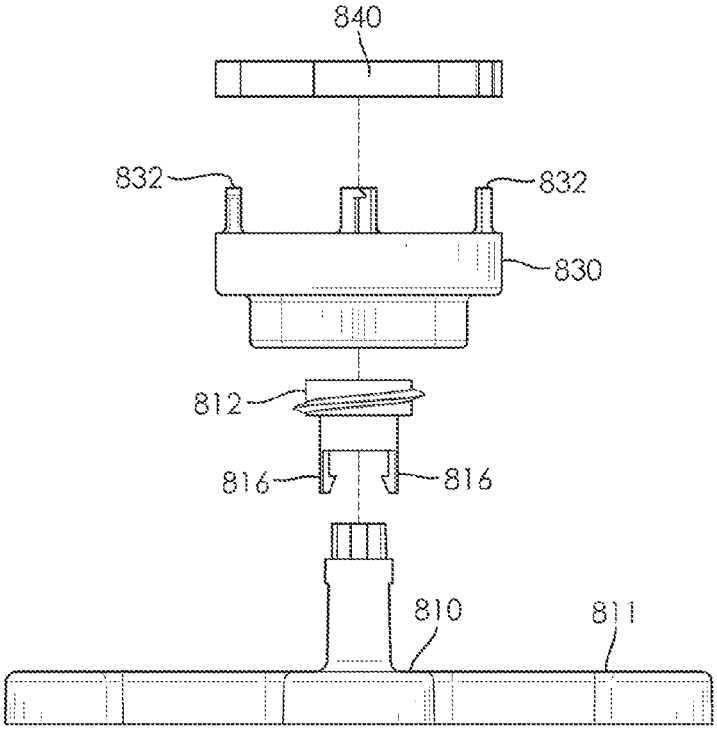
FIG. 9 shows an exploded side view of the twist-lock button with a button adapter for attaching to an existing button according to one embodiment of the present invention.

FIG. 6 shows a perspective view of a preferred embodiment of the present invention. FIG. 7 shows a side profile view of an embodiment of the present invention. FIG. 8 shows an exploded view of the same embodiment of the present invention. The features of this alternate embodiment will be explained with reference to FIG. 8. The same features are also labelled in FIGS. 6, 7, and 9, where visible. Moving from bottom to top, FIG. 8 shows a handle 810 with a grip portion 811, a locking portion 812, a receiver 830, and a button adaptor 840. The collar 120 is notably absent from this embodiment of the invention. This is because this embodiment uses the existing button and button hole of the article of clothing or equipment. The locking portion attached to the handle passes through a button hole and engages with the negative by a twisting 180 degrees. The negative attaches, using a button adapter, to a button that corresponds to the button hole. This embodiment is explained in more detail below.

According to an embodiment of the present invention, the locking portion 812 is a separate piece from the handle, rather than being a single piece as in FIGS. 1-5. The locking portion 812 snaps onto the handle 110 assembly by two or more locking hooks 816 extending from the end of the locking portion 812. The locking portion 812 and handle 810 are configured to mate securely together so that the locking portion 812 and handle 810 cannot rotate relative to each other and torque applied to the handle 810 is effectively transferred to the locking portion 812 to engage it with the negative 130.

In FIG. 8, the negative 130 comprises two components: a receiver 830, which receives the locking portion 812 in the same manner as the negative 130, and a button adapter 840. Together, the receiver 830 and the button adaptor 840 allow the receiver 830 to hold onto a button of a garment or other article, providing an alternate means of attaching the negative 130 or receiver 830 to a garment or other article.

The button adapter 840 is a plate with a center opening 841 and a side channel 842 that extends from the center opening 841 all the way to one outside edge. The side channel 842 provides a pathway for the attachment means between a button and an article of clothing to pass through the side channel 842 into the center opening 841 of the button adapter 841. This allows the button adapter 841 to slip under existing buttons and hold the button roughly at its center with the button adapter 841 lying between the bottom side of the button and the top side of the article it is attached to. The receiver 830 then fits over the top of the button and a plurality of locking hooks 832 engage with hook channels 843 on the button adapter, securely encapsulating the button and attaching the receiver 830 to a garment through the existing button.

According to an embodiment of the present invention, the hook channels 843 are holes which pass through the plate without a passage to an outside edge of the plate. In this case, the locking hooks 832 pass straight through the plate and either rotate into the locked position or snap into the locked position.

According to an embodiment of the present invention, an access passage 844 runs from the outer edge of the plate into each of the hook channels 843. The locking hooks 832 pass along the access passage 844 into the locking channels 843 by a twisting or rotating motion, such that the hooks slide into the hook channels 843 and are retained by the body of the plate. One of ordinary skill in the art would recognize that the locking hooks may be oriented in any direction and the hook channels sized and positioned appropriately to provide for rotation or snapping into the locked position as desired.

According to an embodiment of the present invention, a retaining nub 845 is positioned where the access passage 844 meets the locking channel 843. The retaining nub slightly narrows the opening where the access passage 844 meets the locking channel 843 so that the locking hooks 832 are prevented from slipping out of the locked position by rotation of the button adapter 840 relative to the receiver 830. The locking hooks 832 rotate and snap into the locked position as they slide over the retaining nub.

It is possible to take one or more features of the alternate embodiment of FIGS. 6-8 and incorporate it into the invention described in FIGS. 1-4. For example, the twist-lock button of FIGS. 1-4 could have a multi-piece negative 130 comprising a receiver 830 and a button adapter 840. One of ordinary skill in the art would recognize that there are a variety of ways to mix and match the components of FIGS. 1-4 with those of FIGS. 6-9 without departing from the spirit and scope of the present invention.

Figure 10:
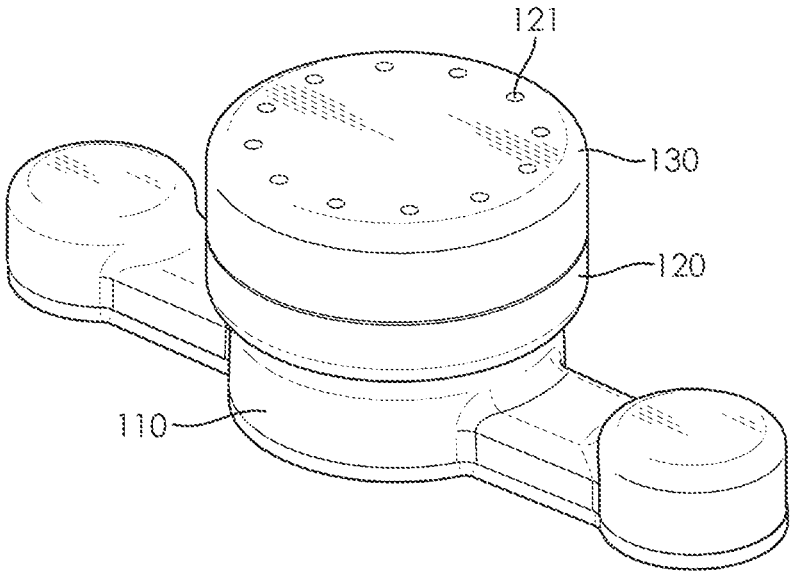
FIG. 10 is a perspective view of the twist-lock button in the locked state according to one embodiment of the present invention.
Figure 11:
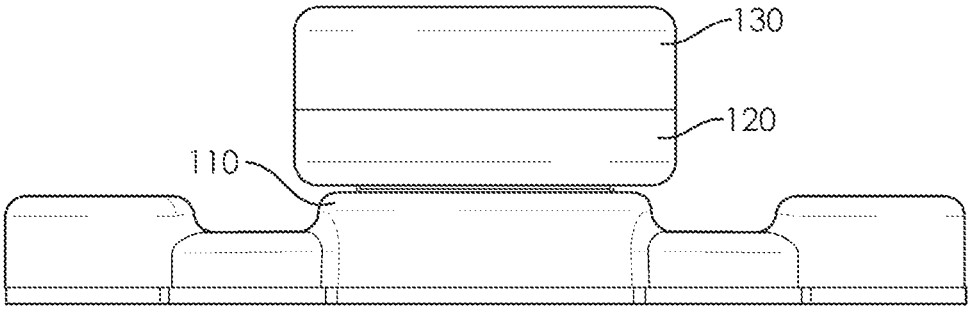
FIG. 11 is a side view of the twist-lock button in the locked state according to one embodiment of the present invention.
Figure 12:
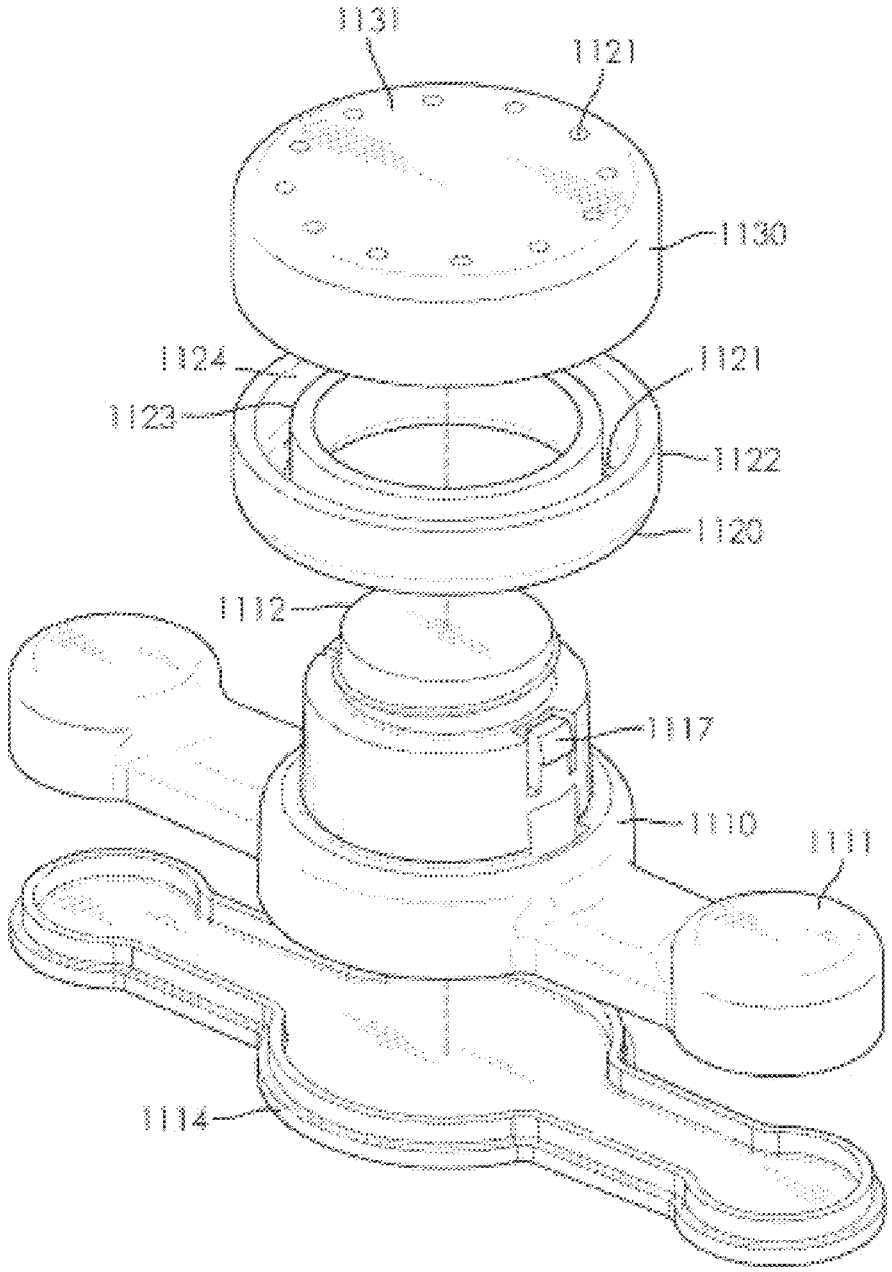
FIG. 12 shows an exploded perspective view of the twist-lock button according to one embodiment of the present invention.
Figure 13:
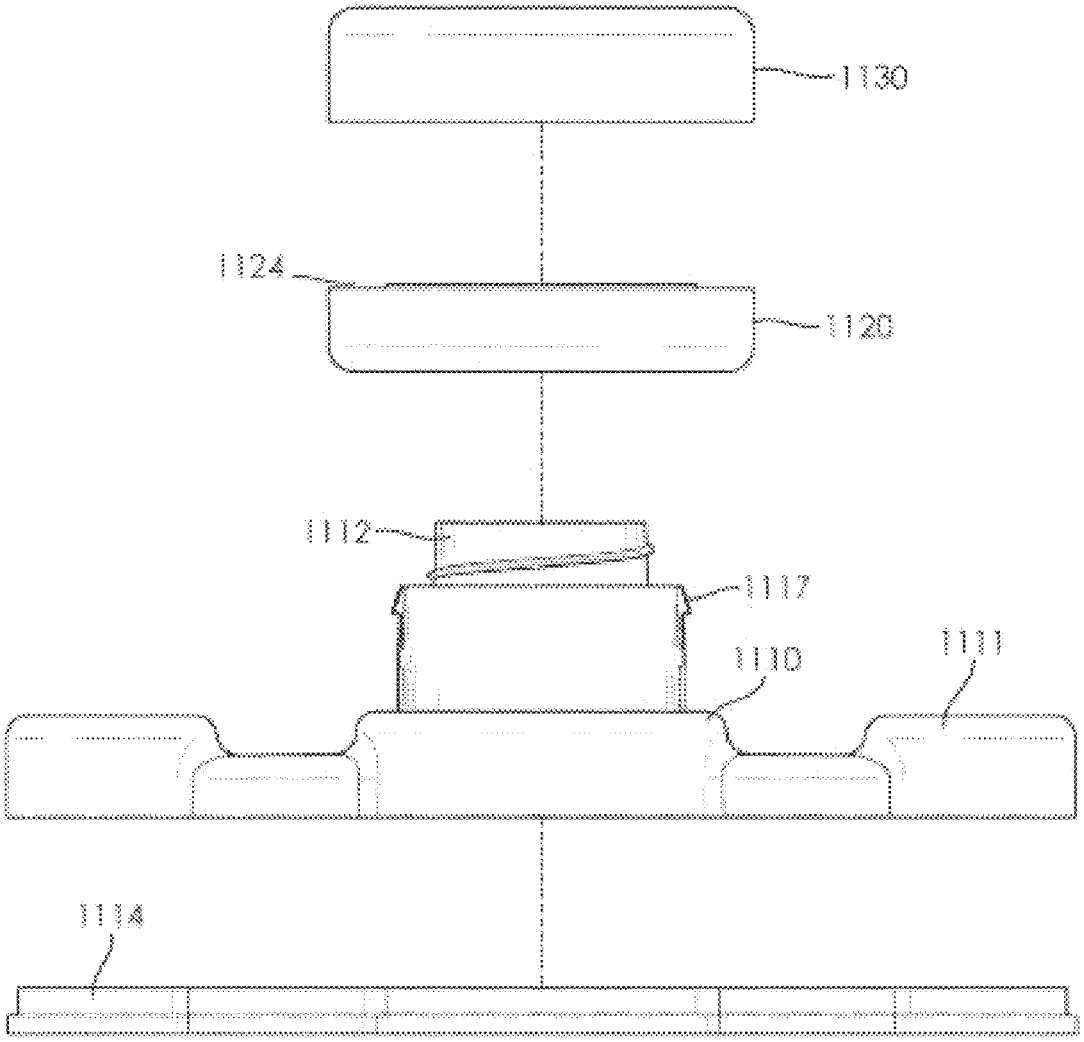
FIG. 13 shows an exploded side view of the twist-lock button according to one embodiment of the present invention.

Another alternate embodiment of the present invention is described with reference to FIGS. 10-13. FIG. 10 is a perspective view of an alternate embodiment of the twist-lock button in the locked state. FIG. 11 is a side view of the same embodiment of the twist lock button in the locked state. FIG. 12 shows an exploded perspective view of the same embodiment of the invention in the unlocked state, and FIG. 13 show and exploded side view. The negative 1130 and collar 1120 shown in FIG. 12 are similar to the negative 130 and collar 120 of FIGS. 1-4, except they do not have a horizontal ridge with thread holes 121. Instead, the thread holes 1121 pass through the main body of the negative 1130 and collar 1120. The collar 1120 is formed of a substantially flat base circle with an outer sidewall 1122 rising from the outer perimeter and an inner sidewall 1123 rising from the inner perimeter. The outer sidewall 1122 and inner sidewall 1123 form a u-shaped circular perimeter channel 1124 or gap between them. At the bottom of this perimeter channel 1124, the thread holes 1121 pass through the base circle, and the threads are protected from direct contact with moving parts or sources of abrasion. The inner sidewall 1123 forms a hole through which the handle 1110 and locking portion 1112 pass to engage and lock with the negative 1130.

The negative 1130 is similar in shape to the collar 1120, except the base is formed of a circular base disc 1131 without a hole passing through the center. Not shown in FIG. 12 is the mechanism on the negative 1130 for engaging with the locking portion 1112 of the handle 1110. This mechanism is explained in detail with reference to FIG. 3 earlier in the specification. In an alternate embodiment, the negative 1130 could have a hole passing through in similar fashion to the collar 1120. This hole would allow for the locking portion 1112 to pass through the negative 1130 so that the end of the locking portion 1112 is flush with the circular base disc (which would be a ring of material in this case) of the negative 1130, allowing for a slightly more compact twist-lock button when in the locked position and reducing the amount of material required to manufacture the negative 1130. In another alternate embodiment, the gap between the inner cavity (not shown in FIG. 12) and outer sidewall of the negative 1130 is filled with material, and the thread holes 1121 pass through the full thickness of the negative 1130. This would provide additional strength and prevent flex that could cause the locking portion 1112 to disengage from the negative 1130. One of ordinary skill in the art would recognize that many details of both the negative and the collar could be modified or combined without departing from the spirit and scope of the present invention.

According to an embodiment of the present invention depicted in FIG. 12, the handle 1110 has a plurality of locking tabs 1117 which snap into the collar 1120 securing the handle 1110 and collar 1120 together while allowing the handle 1110 to rotate freely relative to the collar 1120. According to an embodiments of the present invention, the handle 1110 may be comprised of a grip portion 1111, and a lid 1114. When put together, the grip portion 1111 and the lid 1114 form the handle 1110 assembly.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A twist-lock fastener comprising:

a handle comprising a grip portion configured to be rotatable by a human hand;

a negative;

a negative connector on said negative for attaching said negative to an article of clothing or equipment, the negative connector comprising a plurality of thread holes and further comprising a perimeter channel recessed into said negative, said perimeter channel formed by an interior sidewall and an exterior sidewall and the plurality of said thread holes passing through a bottom of said perimeter channel;

a locking portion; and a cylindrical interior cavity with an interior wall and an opening at one end;

wherein said handle and said negative mate together by the locking portion being received into said interior cavity and said locking portion and said interior cavity rotate relative to each other into a locked position.

2. The fastener of claim 1 wherein said locking portion comprises a cylindrical extension.

3. The fastener of claim 2 wherein said locking portion further comprises a raised ridge extending from a base of said cylindrical extension and moving around said cylindrical extension as said raised ridge approaches an end opposite the base of said cylindrical extension and wherein said interior cavity is configured to engage with said raised ridge and rotate into a locked position.

4. The fastener of claim 1 wherein said negative connector comprises a surface opposite the opening of said interior cavity for applying an adhesive.

5. The fastener of claim 1 further comprising a collar formed of a ring of material configured to allow said locking portion to pass through said collar and mate with said interior cavity.

6. The fastener of claim 5 wherein said collar comprises a collar connector for attaching said collar to an article of clothing or equipment.

7. The fastener of claim 6 wherein said collar connector comprises a plurality of thread holes.

8. The fastener of claim 7 wherein said collar connector further comprises a perimeter channel recessed into said collar, said perimeter channel formed by an interior sidewall and an exterior sidewall and the plurality of thread holes passing through a bottom of said perimeter channel.

9. The fastener of claim 5 wherein said handle rotatably attaches to said collar.

10. The fastener of claim 9 wherein said handle attaches to said collar by means of a plurality of hooks which pass through the collar and engage with opposite side of said collar such that the collar and handle rotate freely relative to each other and said handle is retained upon said collar.

11. A twist-lock fastener comprising:

a handle comprising a grip portion configured to be rotatable by a human hand;

a negative;

a negative connector on said negative for attaching said negative to an article of clothing or equipment;

a locking portion;

a cylindrical interior cavity with an interior wall and an opening at one end; and a collar formed of a ring of material configured to allow said locking portion to pass through said collar and mate with said interior cavity, the collar comprising a collar connector for attaching said collar to an article of clothing or equipment, the collar connector comprising a plurality of thread holes and further comprising a perimeter channel recessed into said collar, said perimeter channel formed by an interior sidewall and an exterior sidewall and the plurality of thread holes passing through a bottom of said perimeter channel;

wherein said handle and said negative mate together by the locking portion being received into said interior cavity and said locking portion and said interior cavity rotate relative to each other into a locked position.

12. The fastener of claim 11 wherein said locking portion comprises a cylindrical extension.

13. The fastener of claim 12 wherein said locking portion further comprises a raised ridge extending from a base of said cylindrical extension and moving around said cylindrical extension as said raised ridge approaches an end opposite the base of said cylindrical extension and wherein said interior cavity is configured to engage with said raised ridge and rotate into a locked position.

14. The fastener of claim 11 wherein said negative connector comprises a surface opposite the opening of said interior cavity for applying an adhesive.

15. The fastener of claim 11 wherein said handle rotatably attaches to said collar.

16. The fastener of claim 15 wherein said handle attaches to said collar by means of a plurality of hooks which pass through the collar and engage with opposite side of said collar such that the collar and handle rotate freely relative to each other and said handle is retained upon said collar.

17. The fastener of claim 11 wherein the negative connector comprises a plurality of thread holes.

* * * * *